US010573238B2

(12) United States Patent
Nitawaki

(10) Patent No.: US 10,573,238 B2
(45) **Date of Patent: *Feb. 25, 2020**

(54) DISPLAY DRIVER AND METHOD FOR DRIVING DISPLAY DEVICE

(71) Applicant: LAPIS Semiconductor Co., Ltd., Yokohama (JP)

(72) Inventor: Shouji Nitawaki, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/399,948

(22) Filed: Apr. 30, 2019

(65) Prior Publication Data

US 2019/0259334 A1 Aug. 22, 2019

Related U.S. Application Data

(63) Continuation of application No. 15/361,261, filed on Nov. 25, 2016, now Pat. No. 10,297,198.

(30) Foreign Application Priority Data

Nov. 27, 2015 (JP) ..... 2015-231604

(51) Int. Cl.

| | |
|---|---|
| ***G09G 5/10*** | (2006.01) |
| ***G09G 3/3241*** | (2016.01) |
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3241* (2013.01); *G09G 3/3233* (2013.01); *G09G 3/3266* (2013.01); *G09G 3/3291* (2013.01); *G09G 2300/0408* (2013.01); *G09G 2300/0819* (2013.01); *G09G 2300/0842* (2013.01); *G09G 2310/0294* (2013.01); *G09G 2310/0297* (2013.01); *G09G 2310/08* (2013.01); *G09G 2320/043* (2013.01)

(58) Field of Classification Search

CPC ... G09G 2300/0408; G09G 2300/0819; G09G 2300/0842; G09G 2310/0294; G09G 2310/0297; G09G 2310/08; G09G 2320/043; G09G 3/3233; G09G 3/3241; G09G 3/3266; G09G 3/3291

See application file for complete search history.

(56) References Cited

U.S. PATENT DOCUMENTS

2010/0079430 A1* 4/2010 Yamashita ..... G09G 3/3233 345/210

2010/0091207 A1* 4/2010 Hasegawa ..... G09G 3/003 349/15

FOREIGN PATENT DOCUMENTS

JP 2009-204992 A 9/2009

* cited by examiner

*Primary Examiner* — Insa Sadio

(74) *Attorney, Agent, or Firm* — Rabin & Berdo, P.C.

(57) ABSTRACT

Only once every N horizontal scanning periods, correction processing for providing a correction voltage for correcting a characteristic of a drive transistor for driving a light-emitting element formed in a display device to data lines of the display device and display driving processing for sequentially providing, to the data lines of the display device, gradation voltages for one horizontal scanning line based on a video signal corresponding to each of N horizontal scanning lines are executed.

6 Claims, 7 Drawing Sheets

DISPLAY DRIVER AND METHOD FOR DRIVING DISPLAY DEVICE

CROSS-REFERENCE TO THE RELATED APPLICATIONS

This is a continuation of application Ser. No. 15/361,261, filed on Nov. 25, 2016 (allowed on Jan. 10, 2019), which claims the benefit of priority of Japanese Patent Application No. 2015-231604, filed on Nov. 27, 2015. The disclosures of the prior U.S. and foreign applications are incorporated herein by reference.

BACKGROUND OF THE INVENTION

1. Field of the Invention

The present invention relates to a display driver for driving a display device and a method for driving a display device.

2. Description of the Related Art

Currently known flat (or flat panel) display devices include an organic electroluminescence (EL) panel employing organic EL elements as pixels.

Each pixel in an active matrix-driven organic EL panel includes an organic EL element and a drive transistor for providing, to the organic EL element, a driving current to cause the organic EL element to emit light. The drive transistor is typically a thin film transistor using polysilicon or amorphous silicon, for example. Such thin film transistors, however, have large variations in carrier mobility and threshold voltage.

In view of this, there has been proposed a driving method for driving an organic EL panel according to which drive transistors are driven as follows for each horizontal scanning period so that organic EL elements are driven to emit light while performing corrections of the mobility and threshold voltage of each drive transistor (see Japanese Patent Application Laid-Open No. 2009-204992, for example). More specifically, for each horizontal scanning period, a first offset voltage for correcting the threshold voltage is first applied to a gate terminal of each drive transistor, a second offset voltage for correcting the mobility is subsequently applied to the gate terminal of each drive transistor, and thereafter a voltage corresponding to pixel data is applied to the gate terminal of each drive transistor to cause the organic EL element to emit light.

SUMMARY OF THE INVENTION

According to the above-described driving method, however, a period for correcting the threshold voltage of the drive transistor and a period for correcting the mobility of the drive transistor need to be provided within one horizontal scanning period.

An increase in the resolution of the organic EL panel thus leads to shortening of one horizontal scanning period accordingly. Due to element delay, the above-described correction offset voltages can no longer reach desired voltage values and it becomes difficult to have a sufficient emission period for causing the organic EL element to emit light. Therefore, with the above-described driving method, a higher resolution of the organic EL panel causes deterioration in image quality and screen brightness.

In view of this, it is an object of the present invention to provide a display driver and a method for driving a display device capable of reducing variations in the characteristics of drive transistors and obtaining high-definition and high-brightness display images even when the display device has a higher resolution.

A first aspect of the present invention provides a display driver for driving, in accordance with a video signal, a display device having pixel cells, each including a light-emitting element and a drive transistor for providing a driving current to the light-emitting element, formed at respective intersections between a plurality of horizontal scanning lines and a plurality of data lines. The display driver includes: a data latch unit that holds pixel data pieces representing luminance levels of pixels based on the video signal; a gradation voltage converting unit that generates gradation voltages corresponding to the pixel data pieces held in the data latch unit; and an output unit that executes, only once every N (N is an integer of 2 or greater) horizontal scanning periods, processing for providing a correction voltage for correcting a characteristic of the drive transistor to the plurality of data lines and processing for sequentially providing the gradation voltages for one horizontal scanning line, corresponding to each of N of the horizontal scanning lines, to the plurality of data lines.

A second aspect of the present invention provides a display device driving method for driving, in accordance with a video signal, a display device having pixel cells, each including a light-emitting element and a drive transistor for providing a driving current to the light-emitting element, formed at respective intersections between a plurality of horizontal scanning lines and a plurality of data lines. The display device driving method sequentially executes, every N (N is an integer of 2 or greater) horizontal scanning periods, a correction step of providing a correction voltage for correcting a characteristic of the drive transistor to the plurality of data lines and a display driving step of sequentially providing gradation voltages for one horizontal scanning line based on the video signal corresponding to each of N of the horizontal scanning lines to the plurality of data lines.

According to the present invention, only once every N (N is an integer of 2 or greater) horizontal scanning periods, the correction processing for providing the correction voltage for correcting the characteristic of the drive transistor for driving the light-emitting element formed in the display device to the data lines of the display device and the display driving processing for sequentially providing, to the data lines of the display device, the gradation voltages for one horizontal scanning line based on the video signal corresponding to each of N horizontal scanning lines are executed.

Thus, according to the present invention, a period spent for the correction processing and the display driving processing can be prolonged as compared to a case where the correction processing for correcting the characteristic of the drive transistor is performed for each horizontal scanning period. This makes it possible to reduce adverse effects due to variations in the characteristic of the drive transistors and obtain high-definition and high-brightness images even when the display device has a higher resolution.

DETAILED DESCRIPTION OF THE INVENTION

Figure 1:
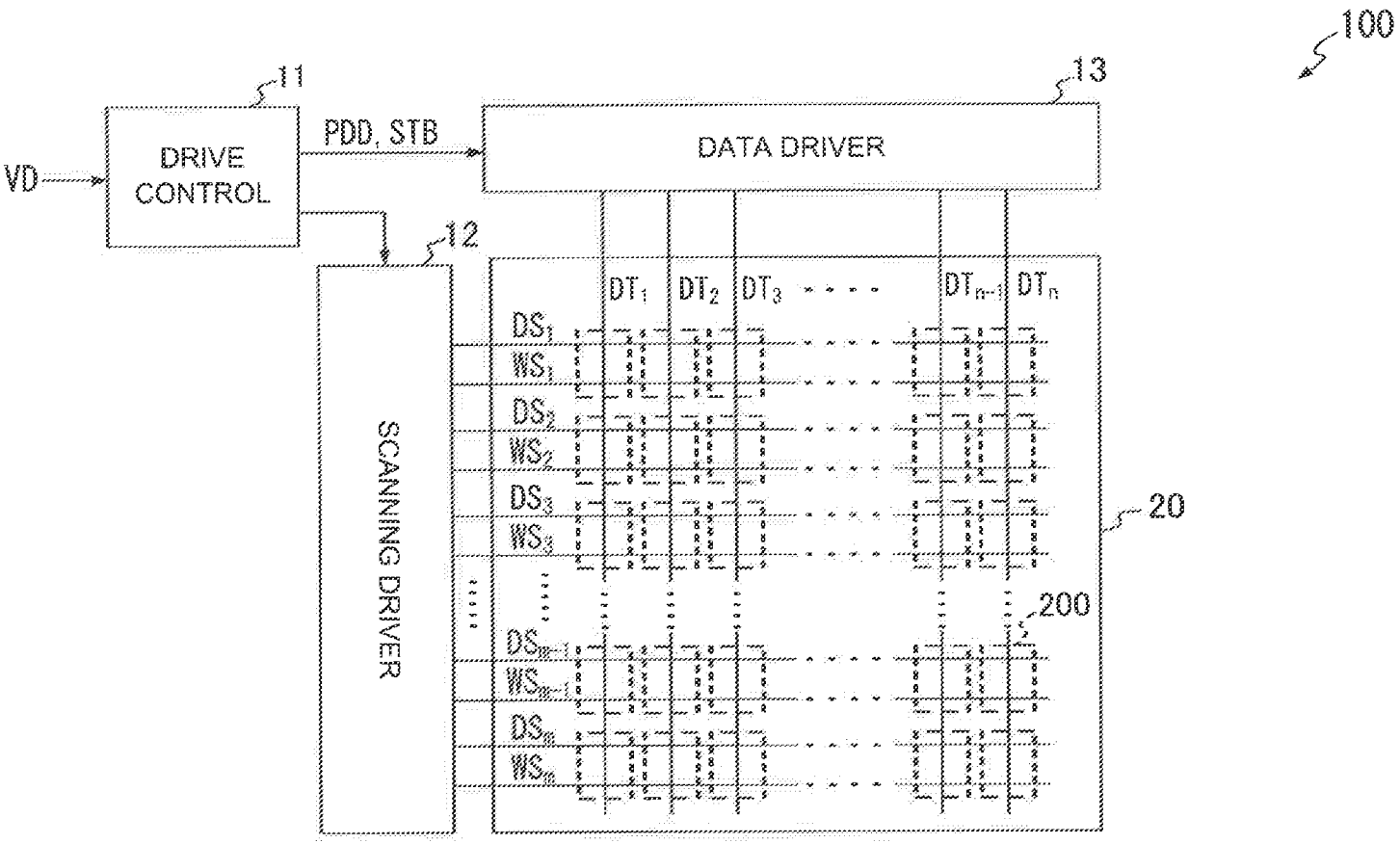
FIG. 1 is a block diagram illustrating a general configuration of an EL display apparatus 100 including a display driver according to the present invention.

FIG. 1 is a block diagram illustrating a general configuration of an EL display apparatus 100 including a display driver according to the present invention. In FIG. 1, a display device 20 includes an organic EL panel, for example. The display device 20 includes m (m is a natural number greater than or equal to 2) write control lines $WS_1$ to $WS_m$ and m power-supply lines $DS_1$ to $DS_m$ extending in a horizontal direction of a two-dimensional screen and n (n is an even number greater than or equal to 2) data lines $DT_1$ to $DT_n$ extending in a vertical direction of the two-dimensional screen. At intersections (i.e., regions surrounded by broken lines) between the write control lines WS and the data lines DT, display cells 200, which function as pixels, are formed. Note that a pair of a write control line $WS_{(k)}$ (k is an integer of 1 to n) and a power-supply line $DS_{(k)}$ forms one horizontal scanning line.

Figure 2:
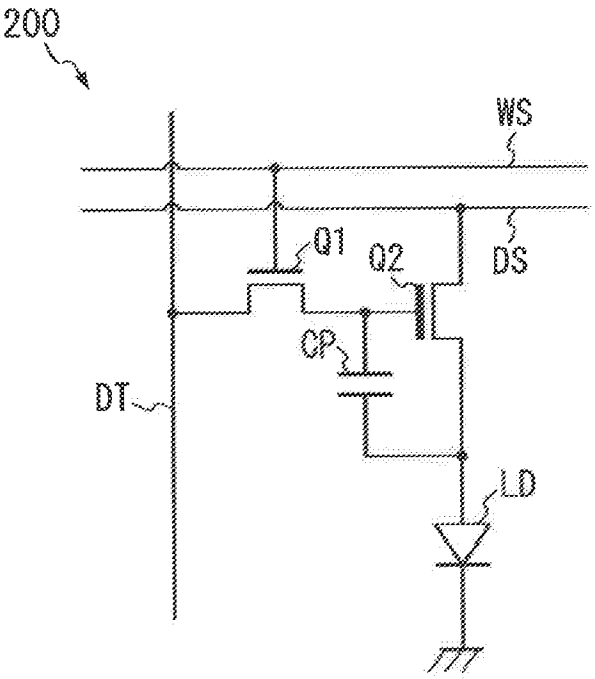
FIG. 2 is a circuit diagram illustrating a configuration of a pixel cell 200.

FIG. 2 is a circuit diagram illustrating an example of the internal configuration of a pixel cell 200. As shown in FIG. 2, the pixel cell 200 includes n-channel metal oxide semiconductor (MOS) transistors Q1 and Q2, a capacitor CP, and an EL element LD.

The data line DT is connected to a source terminal of the transistor Q1 for capturing data, and the write control line WS is connected to a gate terminal of the transistor Q1. One end of the capacitor CP and a gate terminal of the transistor Q2 are connected to a drain terminal of the transistor Q1. The other end of the capacitor CP is connected to a drain terminal of the transistor Q2, which serves as a drive transistor, and an anode terminal of the EL element LD. A source terminal of the transistor Q2 is connected to the power-supply line DS. A ground potential is applied to a cathode terminal of the EL element LD.

With such a configuration, the transistor Q1 for capturing data is turned on (i.e., ON state) when the gate terminal thereof receives a write voltage via the write control line WS. The transistor Q1 then provides a voltage received at the source terminal thereof via the data line DT to the gate terminal of the transistor Q2. When the transistor Q2, which serves as a drive transistor, receives a power-supply voltage at the source terminal thereof via the power-supply line DS, the transistor Q2 sends out a driving current corresponding to the voltage applied to the gate terminal thereof to the EL element LD via the drain terminal thereof. The EL element LD, which functions as a light-emitting element, emits light responsive to the driving current.

A drive control unit 11 detects a horizontal synchronizing signal from a video signal VD and provides the horizontal synchronizing signal to a scanning driver 12. On the basis of the video signal VD, the drive control unit 11 also generates an image data signal PDD containing a sequence of pixel data PD representing the luminance levels of pixels by 8-bit 256-level luminance gradations, for example. The drive control unit 11 then provides the generated image data signal PDD to a data driver 13. Furthermore, the drive control unit 11 provides, to the data driver 13, an output timing signal STB that represents output timing of various voltages to be provided to the data lines $DT_1$ to $DT_n$ of the display device 20.

The scanning driver 12 applies a write pulse having a write voltage to each of the write control lines $WS_1$ to $WS_m$ of the display device 20 at timing synchronized with the horizontal synchronizing signal provided by the drive control unit 11. Furthermore, the scanning driver 12 provides the power-supply voltage to each of the power-supply lines $DS_1$ to $DS_m$ of the display device 20 at the timing synchronized with the horizontal synchronizing signal.

The data driver 13 is formed in a semiconductor integrated circuit (IC) chip. The data driver 13 captures one horizontal scanning line of pixel data PD, i.e., n pieces of pixel data PD, in the image data signal PDD at a time. The data driver 13 then generates pixel driving voltages $G_1$ to $G_n$ having gradation voltages corresponding to luminance gradations represented by the captured n pieces of pixel data or correction voltages (to be described later). The data driver 13 then applies the pixel driving voltages $G_1$ to $G_n$ to the data lines $DT_1$ to $DT_n$ of the display device 20.

Figure 3:
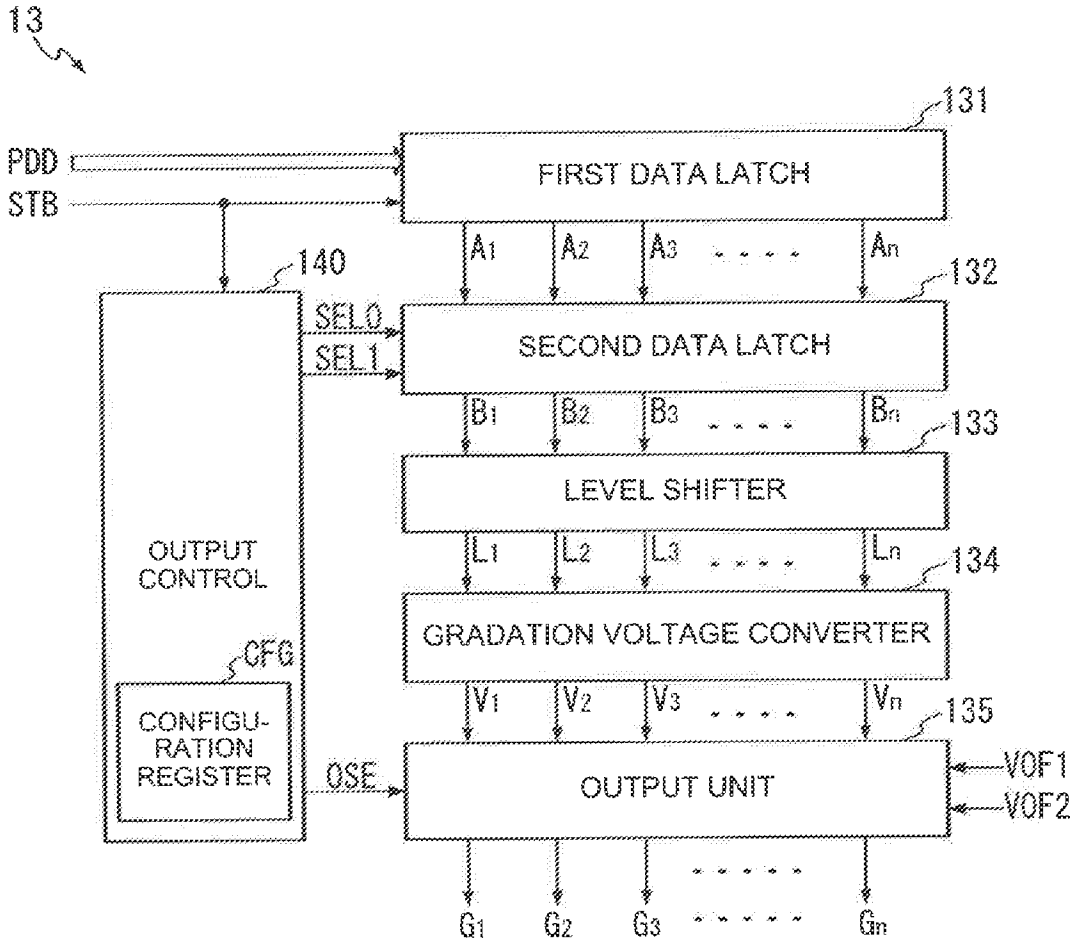
FIG. 3 is a block diagram illustrating a configuration of a data driver 13 serving as the display driver according to the present invention.

FIG. 3 is a block diagram illustrating an internal configuration of the data driver 13 serving as the display driver according to the present invention. In FIG. 3, a first data latch unit 131 captures the sequence of pixel data PD from the image data signal PDD provided by the drive control unit 11. Every time the first data latch unit 131 captures n pieces of pixel data PD for one horizontal scanning line, the first data latch unit 131 provides the n pieces of pixel data $PD_1$ to $PD_n$ to a second data latch unit 132 as pixel data signals $A_1$ to $A_n$ at the timing synchronized with the output timing signal STB.

Figure 4:
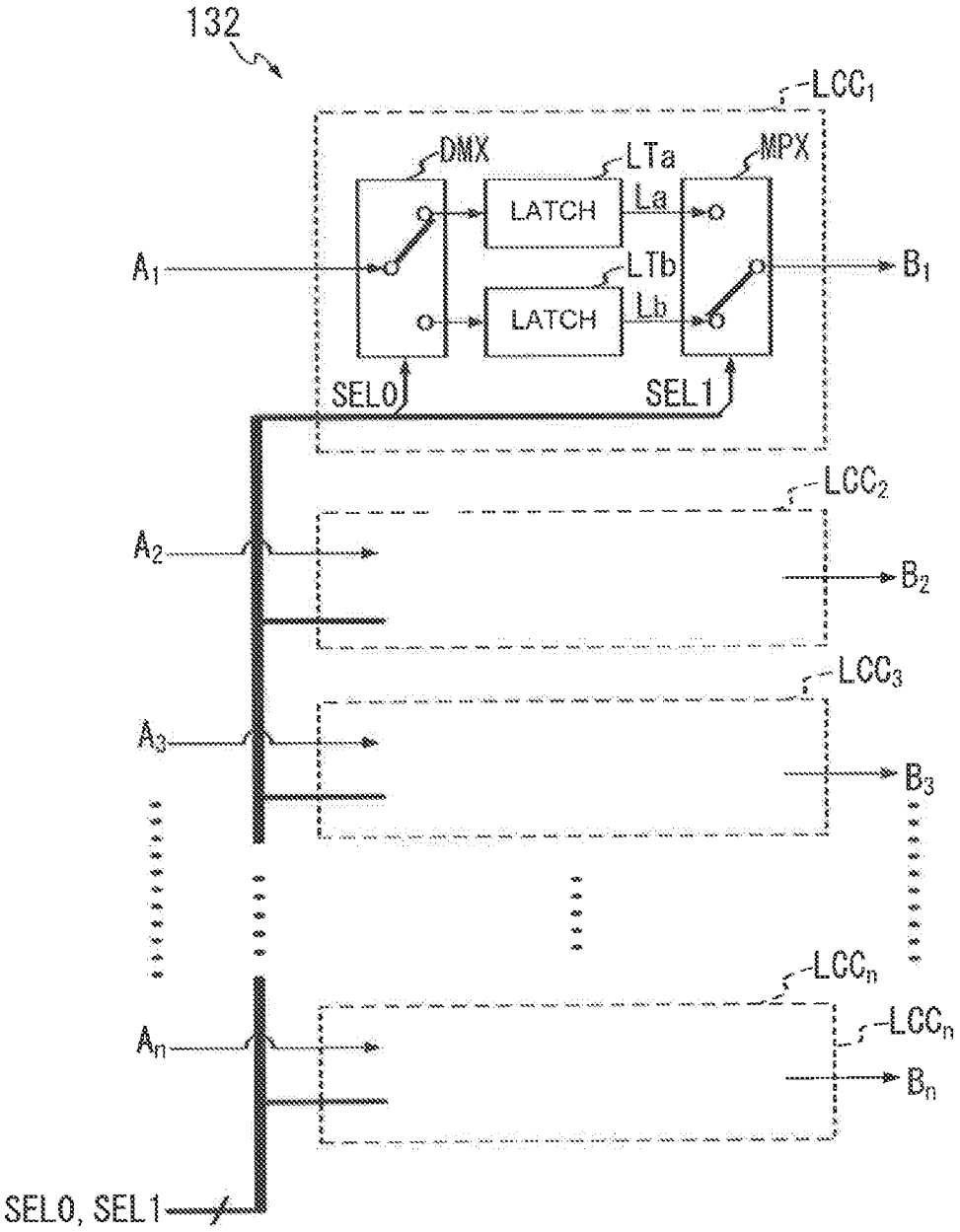
FIG. 4 is a circuit diagram illustrating an internal configuration of a second data latch unit 132.

FIG. 4 is a circuit diagram illustrating an internal configuration of the second data latch unit 132. As shown in FIG. 4, the second data latch unit 132 includes latch circuits $LCC_1$ to $LCC_n$ provided corresponding to the pixel data signals $A_1$ to $A_n$, respectively. The latch circuits $LCC_1$ to $LCC_n$ have the same internal configuration and each include a demultiplexer DMX, a multiplexer MPX, a first latch LTa, and a second latch LTb.

With reference to the latch circuit $LCC_{(k)}$ (k is an integer of 1 to n) of the latch circuits $LCC_1$ to $LCC_n$, the operations of the demultiplexer DMX, the multiplexer MPX, and the latches LTa and LTb will now be described below.

The demultiplexer DMX provides the pixel data signal $A_{(k)}$ to one of the first latch LTa and the second latch LTb in accordance with a latch selection signal SEL0. For example, when the latch selection signal SEL0 has a logic level 0, the demultiplexer DMX provides the pixel data signal $A_{(k)}$ to the first latch LTa. When the latch selection signal SEL0 has a logic level 1, on the other hand, the demultiplexer DMX provides the pixel data signal $A_{(k)}$ to the second latch LTb.

The first latch LTa holds the pixel data signal $A_{(k)}$ provided by the demultiplexer DMX and provides the pixel data signal $A_{(k)}$ to the multiplexer MPX as a latch pixel data signal La. The second latch LTb holds the pixel data signal $A_{(k)}$ provided by the demultiplexer DMX and provides the pixel data signal $A_{(k)}$ to the multiplexer MPX as a latch pixel data signal Lb.

The multiplexer MPX selects one of the latch pixel data signals La and Lb in accordance with a latch selection signal SEL1 and outputs the selected signal as a pixel data signal $B_{(k)}$.

With such a configuration, the second data latch unit 132 holds the pixel data signals $A_1$ to $A_n$ in one of a first latch group (LTa) and a second latch group (LTb) specified by the latch selection signal SEL0. The second data latch unit 132 selects contents held in one of the first latch group (LTa) and the second latch group (LTb) specified by the latch selection signal SEL1 and provides the selected contents to a level shift unit 133 as the pixel data signals $B_1$ to $B_n$.

The level shift unit 133 provides, to a gradation voltage converting unit 134, pixel data signals $L_1$ to $L_n$ obtained by being subjected to level shift for increasing the signal amplitudes of the pixel data signals $B_1$ to $B_n$.

The gradation voltage converting unit 134 converts the pixel data signals $L_1$ to $L_n$ to gradation voltages $V_1$ to $V_n$ having voltage values corresponding to luminance gradations represented by the pixel data signals $L_1$ to $L_n$. The gradation voltage converting unit 134 then provides the gradation voltages $V_1$ to $V_n$ to an output unit 135.

Figure 5:
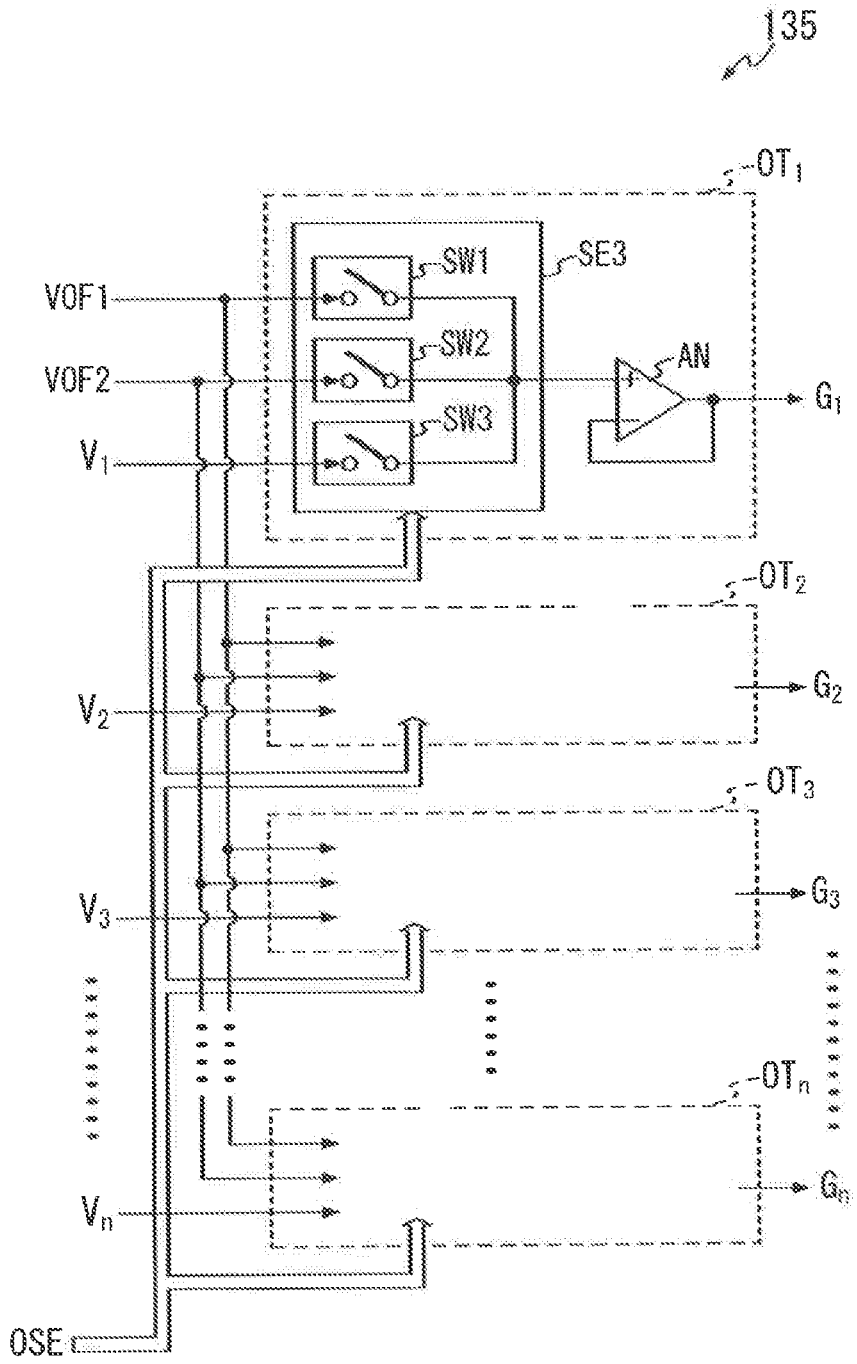
FIG. 5 is a circuit diagram illustrating an internal configuration of an output unit 135.

FIG. 5 is a circuit diagram illustrating an internal configuration of the output unit 135. As shown in FIG. 5, the output unit 135 includes output circuits $OT_1$ to $OT_n$ provided corresponding to the pixel data signals $L_1$ to $L_n$, respectively. The output circuits $OT_1$ to $OT_n$ have the same internal configuration and each include an output selection switch SE3 and an operational amplifier AN.

With reference to the output circuit $OT_{(k)}$ of the output circuits $OT_1$ to $OT_n$, the operations of the output selection switch SE3 and the operational amplifier AN will now be described below.

The output selection switch SE3 includes a switch SW1 that receives a first offset voltage VOF1 at one end thereof, a switch SW2 that receives a second offset voltage VOF2 at one end thereof, and a switch SW3 that receives the gradation voltage $V_{(k)}$ provided by the gradation voltage converting unit 134 at one end thereof. The other ends of the switches SW1 to SW3 are connected to one another. On the basis of an output voltage selection signal OSE, the output selection switch SE3 sets one of the switches SW1 to SW3 to an ON state and sets the other two switches to be off (i.e., OFF state). Alternatively, the output selection switch SE3 sets all of the switches SW1 to SW3 to the OFF state on the basis of the output voltage selection signal OSE.

With such a configuration, the output selection switch SE3 selects the voltage received by the switch set to the ON state from among the first offset voltage VOF1, the second offset voltage VOF2, and the gradation voltage $V_{(k)}$. The output selection switch SE3 then provides the selected voltage (VOF1, VOF2, or $V_{(k)}$) to a non-inverting input terminal of the operational amplifier AN. The first offset voltage VOF1 is, for example, a correction voltage for correcting a threshold voltage of the transistor Q2, which serves as the drive transistor shown in FIG. 2. The second offset voltage VOF2 is, for example, a correction voltage for correcting the mobility of the above-described transistor Q2.

The operational amplifier AN is what is called a voltage follower in which an output terminal thereof is connected to an inverting input terminal thereof. The operational amplifier AN outputs a voltage obtained by amplifying the voltage (VOF1, VOF2, or $V_{(k)}$) provided by the output selection switch SE3 at a gain of 1 as the pixel driving voltage $G_{(k)}$.

With such a configuration, the output unit 135 generates the pixel driving voltages $G_1$ to $G_n$ having the first offset voltage VOF1, the second offset voltage VOF2, or the gradation voltage $V_{(k)}$ provided by the gradation voltage converting unit 134. The output unit 135 applies the pixel driving voltages $G_1$ to $G_n$ to the data lines $DT_1$ to $DT_n$ of the display device 20.

An output control unit 140 includes a configuration register CFG in which the following first to third output setting information pieces S1 to S3 are stored.

The output setting information piece (hereinafter also simply referred to as information) S1 is information for setting whether an output operation is initiated in accordance with a basic output sequence (to be described later) including output processing of the correction voltages (VOF1 and VOF2) for correcting the characteristics of the drive transistor or the output operation in accordance with the basic output sequence is continued. For example, if the output operation in accordance with the basic output sequence is initiated, the output setting information S1 of a logic level 1 is written into the configuration register CFG. If the output operation in accordance with the basic output sequence is continued, on the other hand, the output setting information S1 of a logic level 0 is written into the configuration register CFG.

The output setting information S2 is information for setting whether the first offset voltage VOF1 for correcting the threshold voltage of the drive transistor is provided to the data lines $DT_1$ to $DT_n$ as the correction voltage for correcting the characteristics of the drive transistor. For example, if the first offset voltage VOF1 is provided to the data lines $DT_1$ to $DT_n$, the output setting information S2 of the logic level 1 is written into the configuration register CFG. If no first offset voltage VOF1 is provided to the data lines $DT_1$ to $DT_n$, on the other hand, the output setting information S2 of the logic level 0 is written into the configuration register CFG.

The output setting information S3 is information for setting whether the second offset voltage VOF2 for correcting the mobility of the drive transistor is provided to the data lines $DT_1$ to $DT_n$ as the correction voltage for correcting the characteristics of the drive transistor. For example, if the second offset voltage VOF2 is provided to the data lines $DT_1$ to $DT_n$, the output setting information S3 of the logic level 1 is written into the configuration register CFG. If no second offset voltage VOF2 is provided to the data lines $DT_1$ to $DT_n$, on the other hand, the output setting information S3 of the logic level 0 is written into the configuration register CFG.

For each horizontal scanning period (1H), the output control unit 140 generates the above-described latch selection signals SEL0 and SEL1 and the output voltage selection signal OSE at the timing synchronized with the output timing signal STB on the basis of the contents of the above-described output setting information pieces S1 to S3. The output control unit 140 provides the latch selection signals SEL0 and SEL1 to the second data latch unit 132 and provides the output voltage selection signal OSE to the output unit 135.

Figure 6:
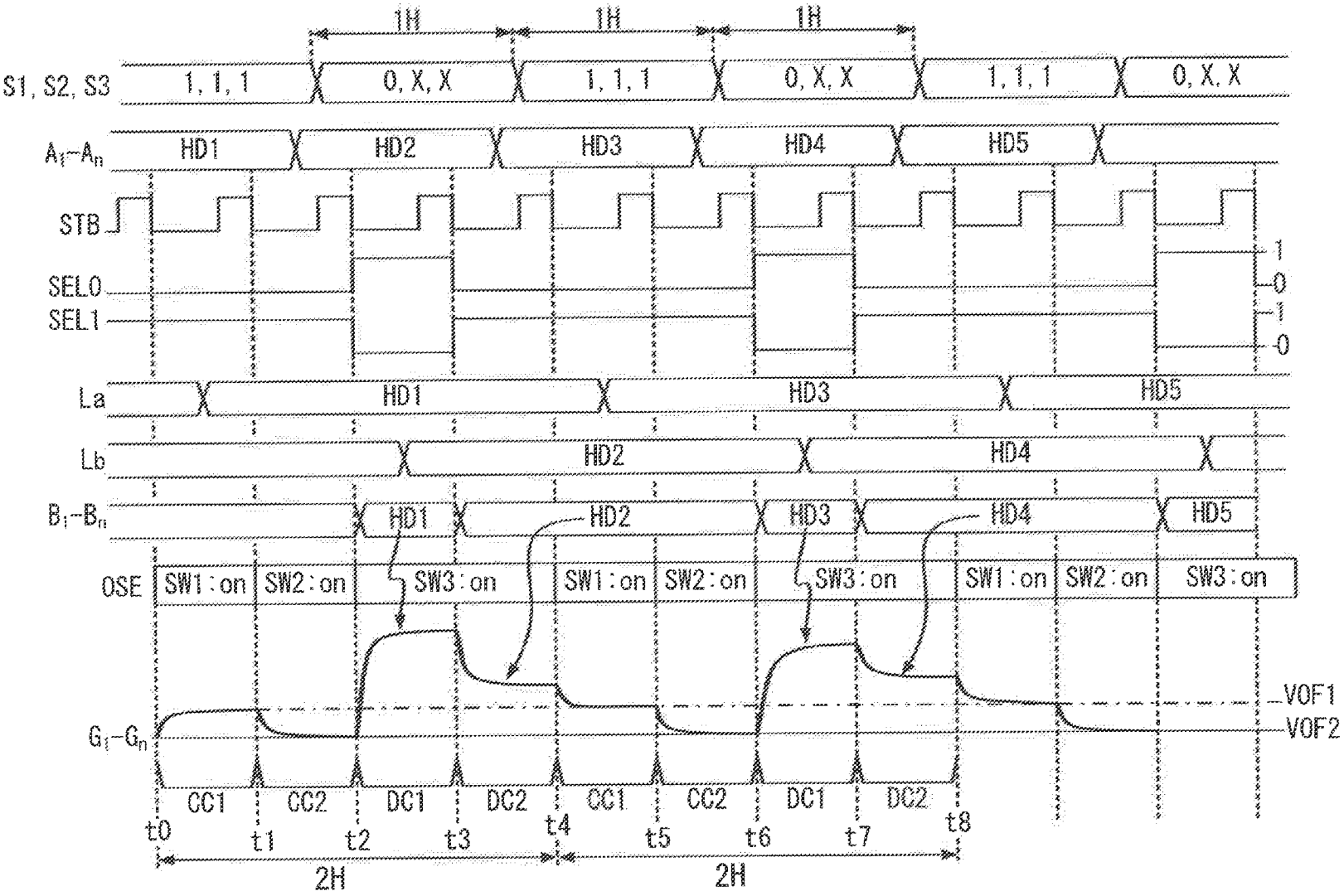
FIG. 6 is a time chart showing an example of operations of the second data latch unit 132 and the output unit 135 performed by an output control unit 140.

The operations of the second data latch unit 132 and the output unit 135 performed in accordance with the latch selection signals SEL0 and SEL1 and the output voltage selection signal OSE generated by the output control unit 140 will now be described below with reference to an example shown in FIG. 6. FIG. 6 is a time chart showing an example of operations performed when pixel data signal groups HD1 to HD5, each corresponding to the first to fifth horizontal scanning lines and each including the pixel data signals $A_1$ to $A_n$, are sequentially outputted from the first data latch unit 131 for each horizontal scanning period (1H).

For each horizontal scanning period (1H), the output control unit 140 sets the output setting information pieces S1 to S3 and overwrites the configuration register CFG.

For example, when a basic output sequence of sequentially executing correction steps CC1 and CC2 and display driving steps DC1 and DC2 shown in FIG. 6 is initiated every two horizontal scanning periods, the output control unit 140 overwrites the configuration register CFG with the output setting information pieces S1 to S3 each representing the logic level 1 (i.e., first output setting). When the operation in accordance with the basic output sequence is continued, the output control unit 140 overwrites the configuration register CFG with the output setting information S1 representing the logic level 0 (i.e., second output setting). In the second output setting, the output setting information pieces S2 and S3 may have the logic level 0 or 1 (denoted by "X" in FIG. 6). The output control unit 140 alternately performs the above-described first output setting and second output setting for each horizontal scanning period (1H) as shown in FIG. 6, for example.

As shown in FIG. 6, the output control unit 140 generates the latch selection signals SEL0 and SEL1, each having a pulse width being half of one horizontal scanning period (1H) and a cycle of two horizontal scanning periods (2H), in synchronization with the output timing signal STB. The output control unit 140 provides these latch selection signals SEL0 and SEL1 to the second data latch unit 132. The latch selection signals SEL0 and SEL1 are signals that transition or change from the logic level 1 (or 0) to the logic level 0 (or 1) at timing synchronized with the falling edge of the output timing signal STB. The latch selection signals SEL0 and SEL1 have phases inverted to each other.

On the basis of the latch selection signals SEL0 and SEL1, the second data latch unit 132 sequentially captures the pixel data signal groups HD1 to HD5 corresponding to the first to fifth horizontal scanning lines, respectively, and provides each of the pixel data signal groups HD1 to HD5 to the level shift unit 133 as the pixel data signals $B_1$ to $B_n$ as will be described below.

More specifically, the second data latch unit 132 first captures and holds the pixel data signal group HD1 ($A_1$ to $A_n$) in the latches LTa of the latch circuits $LCC_1$ to $LCC_n$ shown in FIG. 4. Subsequently, the second data latch unit 132 captures and holds the pixel data signal group HD2 ($A_1$ to $A_n$) in the latches LTb of the latch circuits $LCC_1$ to $LCC_n$. During this period, the second data latch unit 132 provides the pixel data signal group HD1 held in the latches LTa to the level shift unit 133 as the pixel data signals $B_1$ to $B_n$. Subsequently, the second data latch unit 132 captures and holds the pixel data signal group HD3 ($A_1$ to $A_n$) in the latches LTa of the latch circuits $LCC_1$ to $LCC_n$. During this period, the second data latch unit 132 provides the pixel data signal group HD2 held in the latches LTb to the level shift unit 133 as the pixel data signals $B_1$ to $B_n$. Subsequently, the second data latch unit 132 captures and holds the pixel data signal group HD4 ($A_1$ to $A_n$) in the latches LTb of the latch circuits $LCC_1$ to $LCC_n$. During this period, the second data latch unit 132 provides the pixel data signal group HD3 held in the latches LTa to the level shift unit 133 as the pixel data signals $B_1$ to $B_n$. Subsequently, the second data latch unit 132 captures and holds the pixel data signal group HD5 ($A_1$ to $A_n$) in the latches LTa of the latch circuits $LCC_1$ to $LCC_n$. During this period, the second data latch unit 132 provides the pixel data signal group HD4 held in the latches LTb to the level shift unit 133 as the pixel data signals $B_1$ to $B_n$.

In short, while the second data latch unit 132 holds a pixel data signal group for one horizontal scanning line in the latches LTa or LTb of the latch circuits $LCC_1$ to $LCC_n$, the second data latch unit 132 provides the pixel data signal group held in the other one group of the latches LTa and LTb to the level shift unit 133 as the pixel data signals $B_1$ to $B_n$.

Furthermore, if the output setting information pieces S1 to S3 all represent the logic level 1, the output control unit 140 provides, to the output unit 135, the output voltage selection signal OSE for setting only the switch SW1 of the switches SW1 to SW3 shown in FIG. 5 to the ON state at the first falling edge timing of the output timing signal STB since the update of the output setting information pieces S1 to S3 as shown in FIG. 6. Consequently, the output circuits $OT_1$ to $OT_n$ of the output unit 135 apply the pixel driving voltages $G_1$ to $G_n$ having the first offset voltage VOF1 to the data lines $DT_1$ to $DT_n$ of the display device 20 at a time t0 shown in FIG. 6, for example (the correction step CC1). The correction step CC1 cancels out an offset generated in the threshold voltage of the transistor Q2, which serves as the drive transistor formed in each of the pixel cells 200, thereby correcting the threshold voltage to a desired value.

Thereafter, the output control unit 140 provides, to the output unit 135, the output voltage selection signal OSE for setting only the switch SW2 of the switches SW1 to SW3 shown in FIG. 5 to the ON state at the second falling edge timing of the output timing signal STB since the update of the output setting information pieces S1 to S3, e.g., at a time t1 shown in FIG. 6. Consequently, the output circuits $OT_1$ to $OT_n$ of the output unit 135 apply the pixel driving voltages $G_1$ to $G_n$ having the second offset voltage VOF2 to the data lines $DT_1$ to $DT_n$ of the display device 20 at the time t1 shown in FIG. 6 (the correction step CC2). The correction step CC2 cancels out an offset generated in the mobility of the transistor Q2, which serves as the drive transistor formed in each of the pixel cells 200, thereby correcting the mobility to desired mobility.

If the information pieces S1 and S3 among the output setting information pieces S1 to S3 are set to the logic level 1 and the information S2 is set to the logic level 0, the output control unit 140 provides, to the output unit 135, the output voltage selection signal OSE for setting only the switch SW2 to the ON state at the first falling edge timing of the output timing signal STB after the update of the output setting information pieces S1 to S3. Thus, the pixel driving voltages $G_1$ to $G_n$ having the second offset voltage VOF2 are applied to the data lines $DT_1$ to $DT_n$ of the display device 20 at the first falling edge timing of the output timing signal STB after the update of the output setting information pieces S1 to S3.

During the execution of the correction step CC2, the output control unit 140 changes the contents of the output setting information pieces S1 to S3, i.e., changes the output setting information S1 from the logic level 1 to the logic level 0 as shown in FIG. 6. In other words, the output setting information switches to the setting to continue the operation in accordance with the above-described basic output sequence. Thus, the output control unit 140 provides, to the output unit 135, the output voltage selection signal OSE for setting only the switch SW3 of the switches SW1 to SW3 shown in FIG. 5 to the ON state at the first falling edge timing of the output timing signal STB after the update of the output setting information S1 from the logic level 1 to the logic level 0, e.g., at a time t2 shown in FIG. 6. Consequently, the pixel driving voltages $G_1$ to $G_n$ having the gradation voltages $V_1$ to $V_n$ based on the pixel data signal group HD1 are applied to the data lines $DT_1$ to $DT_n$ of the display device 20 at the time t2 shown in FIG. 6 (the display driving step DC1). As a result of the display driving step DC1, the pixel driving voltages $G_1$ to $G_n$ having the gradation voltages $V_1$ to $V_n$ corresponding to the first horizontal scanning line are applied to the display device 20 over a period being half of one horizontal scanning period, for example.

Thereafter, at the second falling edge timing of the output timing signal STB after such update of the output setting information pieces S1 to S3, e.g., at a time t3 shown in FIG. 6, the pixel driving voltages $G_1$ to $G_n$ having the gradation voltages $V_1$ to $V_n$ based on the pixel data signal group HD2 are applied to the data lines $DT_1$ to $DT_n$ of the display device 20 (the display driving step DC2). As a result of the display driving step DC2, the pixel driving voltages $G_1$ to $G_n$ having the gradation voltages $V_1$ to $V_n$ corresponding to the second horizontal scanning line are applied to the display device 20 over a period being half of one horizontal scanning period, for example.

In other words, by switching the contents of the output setting information S1 to the setting (logic level 0) to continue the operation in accordance with the basic output sequence immediately after the time t1 shown in FIG. 6, the output operation in accordance with the basic output sequence is continued, i.e., the display driving steps DC1 and DC2 are sequentially performed following the above-described correction step CC2.

During the execution of the display driving step DC2, the output control unit 140 changes the contents of the output setting information pieces S1 to S3, i.e., changes all of the output setting information pieces S1 to S3 to the logic level 1 as shown in FIG. 6. Thus, the output control unit 140 continuously initiates the output operation in accordance with the basic output sequence (CC1, CC2, DC1, and DC2) at the first falling edge timing of the output timing signal STB after such update of the output setting information pieces S1 to S3, e.g., at a time t4 shown in FIG. 6. More specifically, the output control unit 140 first applies the pixel driving voltages $G_1$ to $G_n$ having the first offset voltage VOF1 to the data lines $DT_1$ to $DT_n$ of the display device 20 (the correction step CC1). The correction step CC1 corrects the threshold voltage of the transistor Q2, which serves as the drive transistor formed in each of the pixel cells 200.

Thereafter, the output control unit 140 provides, to the output unit 135, the output voltage selection signal OSE for setting only the switch SW2 of the switches SW1 to SW3 shown in FIG. 5 to the ON state at the second falling edge timing of the output timing signal STB after such update of the output setting information pieces S1 to S3, e.g., at a time t5 shown in FIG. 6. Consequently, the output circuits $OT_1$ to $OT_n$ of the output unit 135 apply the pixel driving voltages $G_1$ to $G_n$ having the second offset voltage VOF2 to the data lines $DT_1$ to $DT_n$ of the display device 20 as shown in FIG. 6 (the correction step CC2). The correction step CC2 corrects the mobility of the transistor Q2, which serves as the drive transistor formed in each of the pixel cells 200. When the information pieces S1 and S3 of the output setting information pieces S1 to S3 are set to the logic level 1 and the information S2 is set to the logic level 0, the output control unit 140 provides, to the output unit 135, the output voltage selection signal OSE for setting only the switch SW2 to the ON state at the first falling edge timing of the output timing signal STB after the update of the output setting information pieces S1 to S3. Thus, the pixel driving voltages $G_1$ to $G_n$ having the second offset voltage VOF2 are applied to the data lines $DT_1$ to $DT_n$ of the display device 20 at the first falling edge timing of the output timing signal STB after the update of the output setting information pieces S1 to S3.

During the execution of the correction step CC2, the output control unit 140 changes the contents of the output setting information pieces S1 to S3, i.e., changes the output setting information S1 from the logic level 1 to the logic level 0 as shown in FIG. 6. In other words, the output setting information switches to the setting to continue the operation in accordance with the above-described basic output sequence. Thus, the output control unit 140 provides, to the output unit 135, the output voltage selection signal OSE for setting only the switch SW3 of the switches SW1 to SW3 shown in FIG. 5 to the ON state at the first falling edge timing of the output timing signal STB after the update of the output setting information S1 from the logic level 1 to the logic level 0, e.g., at a time t6 shown in FIG. 6. Consequently, the pixel driving voltages $G_1$ to $G_n$ having the gradation voltages $V_1$ to $V_n$ based on the pixel data signal group HD3 are applied to the data lines $DT_1$ to $DT_n$ of the display device 20 (the display driving step DC1). As a result of the display driving step DC1, the pixel driving voltages $G_1$ to $G_n$ having the gradation voltages $V_1$ to $V_n$ corresponding to the third horizontal scanning line are applied to the display device 20 over a period being half of one horizontal scanning period.

Thereafter, at the second falling edge timing of the output timing signal STB after such update of the output setting information pieces S1 to S3, e.g., at a time t7 shown in FIG. 6, the pixel driving voltages $G_1$ to $G_n$ having the gradation voltages $V_1$ to $V_n$ based on the pixel data signal group HD4 are applied to the data lines $DT_1$ to $DT_n$ of the display device 20 (the display driving step DC2). As a result of the display driving step DC2, the pixel driving voltages $G_1$ to $G_n$ having the gradation voltages $V_1$ to $V_n$ corresponding to the fourth horizontal scanning line are applied to the display device 20 over a period being half of one horizontal scanning period.

In other words, by switching the contents of the output setting information S1 to the setting (logic level 0) to continue the operation in accordance with the basic output sequence immediately after the time t5 shown in FIG. 6, the output operation in accordance with the basic output sequence is continued, i.e., the display driving steps DC1 and DC2 are sequentially performed following the above-described correction step CC2.

As described above, the data driver 13 sequentially applies the offset voltages VOF1 and VOF2 for correcting the threshold voltage and mobility of the drive transistor to the display device 20 (CC1 and CC2) only once every two horizontal scanning periods (2H) according to the operation shown in FIG. 6. Within such two horizontal scanning periods, the data driver 13 further applies the gradation voltages $V_1$ to $V_n$ for one horizontal scanning line based on the video signal to the display device 20 (DC1), and subsequently applies the gradation voltages $V_1$ to $V_n$ for the next horizontal scanning line to the display device 20 (DC2). In other words, after processing for correcting the threshold voltage and mobility of the drive transistor (CC1 and CC2), driving for displaying images for one horizontal scanning line (DC1) and driving for displaying images for the next horizontal scanning line (DC2) are sequentially executed.

Since the processing for correcting the threshold voltage and mobility of the drive transistor (Q2) formed in the display device 20 is performed only once every two horizontal scanning periods (2H), a period spent for the above-described correction processing (CC1 and CC2) and the above-described image display driving (DC1 and DC2) can be prolonged as compared to a case where such correction processing is executed for each horizontal scanning period.

Therefore, the data driver 13 shown in FIG. 3 can reduce the adverse effects due to variations in the characteristics of the drive transistor even when the display device 20 has a high resolution. High-definition and high-brightness images can be thus obtained.

Moreover, the contents (S1 to S3) stored in the configuration register CFG can be changed every single horizontal scanning period in the data driver 13 shown in FIG. 3. Thus, for each horizontal scanning line, whether the first offset voltage VOF1 is applied to the horizontal scanning line and whether the second offset voltage VOF2 is applied to the horizontal scanning line can be set. Furthermore, the output timing of the offset voltages (VOF1 and VOF2) and the gradation voltages ($V_1$ to $V_n$) can be externally set as desired by the output timing signal STB in this data driver 13.

Thus, the data driver 13 can be employed for the display devices 20 having various characteristics and resolutions.

Figure 7:
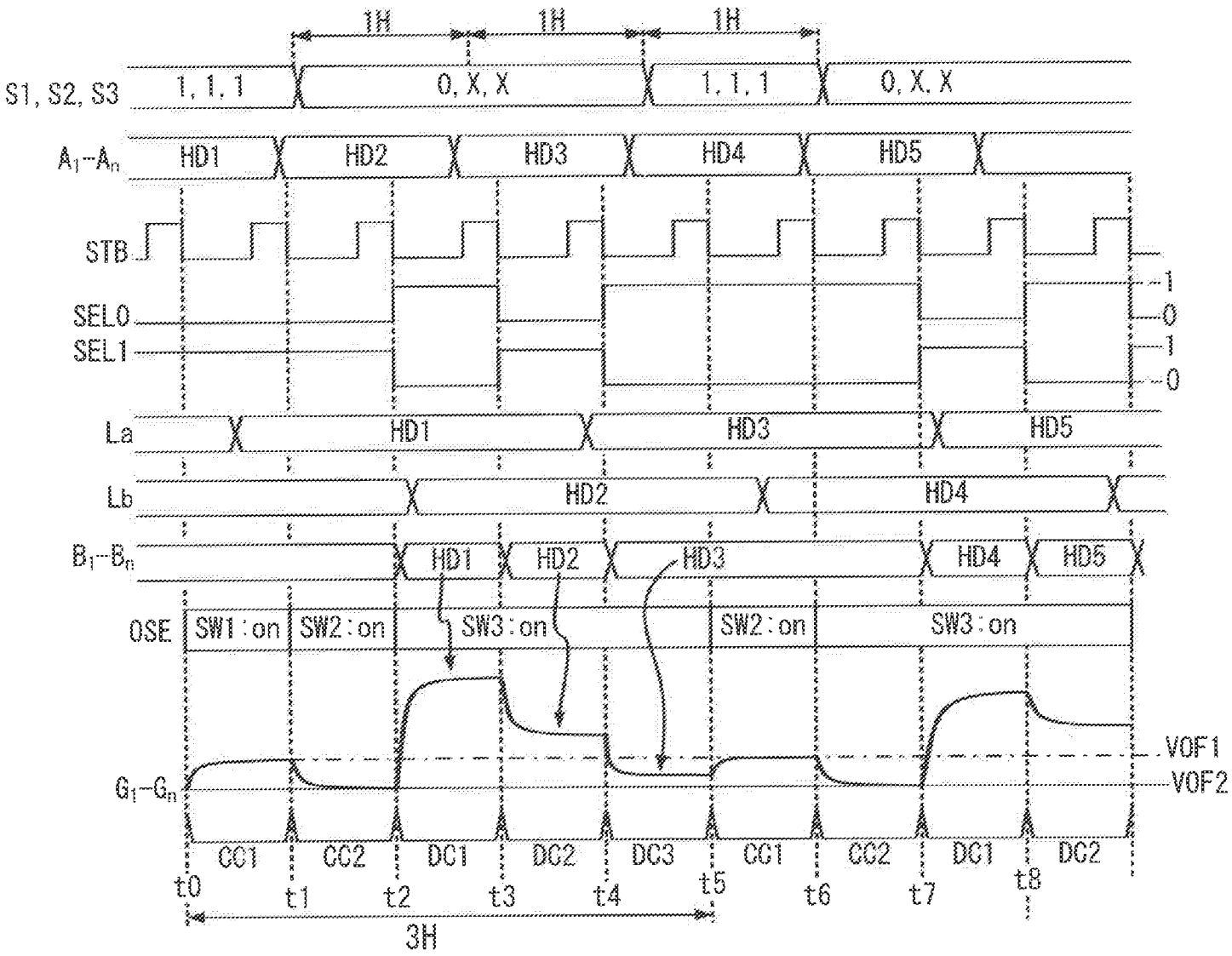
FIG. 7 is a time chart showing another example of operations of the second data latch unit 132 and the output unit 135 performed by the output control unit 140.

Although the correction processing (CC1 and CC2) for correcting the threshold voltage and mobility of the drive transistor is executed once every two horizontal scanning periods in the example shown in FIG. 6, the correction steps CC1 and CC2 may be executed once every three horizontal scanning periods (3H) as shown in FIG. 7. In other words, an output operation in accordance with a basic output sequence of sequentially executing the correction steps CC1 and CC2 and display driving steps DC1, DC2, and DC3 is performed every three horizontal scanning periods as shown in FIG. 7. As with the example shown in FIG. 6, FIG. 7 is a time chart showing an example of control operations performed when pixel data signal groups HD1 to HD5, each corresponding to the first to fifth horizontal scanning lines and each including the pixel data signals $A_1$ to $A_n$, are sequentially outputted from the first data latch unit 131 for each horizontal scanning period (1H).

In the example shown in FIG. 7, when the basic output sequence of sequentially executing the correction steps CC1 and CC2 and the display driving steps DC1, DC2, and DC3 is initiated every three horizontal scanning periods (3H), the output control unit 140 overwrites the configuration register CFG with the output setting information pieces S1 to S3 each representing the logic level 1 (i.e., first output setting). When the operation in accordance with the basic output sequence is continued, the output control unit 140 overwrites the configuration register CFG with the output setting information S1 representing the logic level 0 (i.e., second output setting). In the second output setting, the output setting information pieces S2 and S3 may have the logic level 0 or 1 (denoted by "X" in FIG. 7).

As shown in FIG. 7, the output control unit 140 generates, every three horizontal scanning periods (3H), a latch selection signal SEL0 that transitions in the following manner: the logic level 1, 0, 1, 1, 1, and 0 within the three horizontal scanning periods in synchronization with the falling edge timing of the output timing signal STB and a latch selection signal SEL1 having a phase inverted from that of the latch selection signal SEL0. The output control unit 140 provides the latch selection signals SEL0 and SEL1 to the second data latch unit 132. At this time, with the latch selection signals SEL0 and SEL1, the second data latch unit 132 sequentially captures the pixel data signal groups HD1 to HD5 corresponding to the first to fifth horizontal scanning lines, respectively, and provides each of the pixel data signal groups HD1 to HD5 to the level shift unit 133 as the pixel data signals $B_1$ to $B_n$ as will be described below.

More specifically, the second data latch unit 132 first captures and holds the pixel data signal group HD1 in the latches LTa of the latch circuits $LCC_1$ to $LCC_n$ shown in FIG. 4. Subsequently, the second data latch unit 132 captures and holds the pixel data signal group HD2 in the latches LTb of the latch circuits $LCC_1$ to $LCC_n$. During this period, the second data latch unit 132 provides the pixel data signal group HD1 held in the latches LTa to the level shift unit 133 as the pixel data signals $B_1$ to $B_n$. Subsequently, the second data latch unit 132 captures and holds the pixel data signal group HD3 in the latches LTa of the latch circuits $LCC_1$ to $LCC_n$. During this period, the second data latch unit 132 provides the pixel data signal group HD2 held in the latches LTb to the level shift unit 133 as the pixel data signals $B_1$ to $B_n$. Subsequently, the second data latch unit 132 captures and holds the pixel data signal group HD4 in the latches LTb of the latch circuits $LCC_1$ to $LCC_n$. During this period, the second data latch unit 132 provides the pixel data signal group HD3 held in the latches LTa to the level shift unit 133 as the pixel data signals $B_1$ to $B_n$. Subsequently, the second data latch unit 132 captures and holds the pixel data signal group HD5 in the latches LTa of the latch circuits $LCC_1$ to $LCC_n$. During this period, the second data latch unit 132 provides the pixel data signal group HD4 held in the latches LTb to the level shift unit 133 as the pixel data signals $B_1$ to $B_n$.

In sum, while the second data latch unit 132 holds a pixel data signal group for one horizontal scanning line in the latches LTa or LTb, the second data latch unit 132 provides the pixel data signal group held in the other one group of the latches LTa and LTb to the level shift unit 133 as the pixel data signals $B_1$ to $B_n$.

Furthermore, if the output setting information pieces S1 to S3 all represent the logic level 1, the output control unit 140 provides, to the output unit 135, the output voltage selection signal OSE for setting only the switch SW1 of the switches SW1 to SW3 shown in FIG. 5 to the ON state at the first falling edge timing of the output timing signal STB after the update of the output setting information pieces S1 to S3 as shown in FIG. 7. Consequently, the output circuits $OT_1$ to $OT_n$ of the output unit 135 apply the pixel driving voltages $G_1$ to $G_n$ having the first offset voltage VOF1 to the data lines $DT_1$ to $DT_n$ of the display device 20 at a time t0 shown in FIG. 7, for example (the correction step CC1). The correction step CC1 corrects the threshold voltage of the transistor Q2, which serves as the drive transistor formed in each of the pixel cells 200.

Thereafter, the output control unit 140 provides, to the output unit 135, the output voltage selection signal OSE for setting only the switch SW2 of the switches SW1 to SW3 shown in FIG. 5 to the ON state at the second falling edge timing of the output timing signal STB after the update of the output setting information pieces S1 to S3, e.g., at a time t1 shown in FIG. 7. Consequently, the output circuits $OT_1$ to $OT_n$ of the output unit 135 apply the pixel driving voltages $G_1$ to $G_n$ having the second offset voltage VOF2 to the data lines $DT_1$ to $DT_n$ of the display device 20 at the time t1 shown in FIG. 7 (the correction step CC2). The correction step CC2 corrects the mobility of the transistor Q2, which serves as the drive transistor formed in each of the pixel cells 200.

During the execution of the correction step CC2, the output control unit 140 changes the contents of the output setting information pieces S1 to S3, i.e., changes the output setting information S1 from the logic level 1 to the logic level 0 as shown in FIG. 7. In other words, the output setting information switches to the setting to continue the operation in accordance with the above-described basic output sequence. Thus, the output control unit 140 provides, to the output unit 135, the output voltage selection signal OSE for setting only the switch SW3 of the switches SW1 to SW3 shown in FIG. 5 to the ON state at the first falling edge timing of the output timing signal STB after the update of the output setting information S1 from the logic level 1 to the logic level 0, e.g., at a time t2 shown in FIG. 7. Consequently, the pixel driving voltages $G_1$ to $G_n$ having the gradation voltages $V_1$ to $V_n$ based on the pixel data signal group HD1 are applied to the data lines $DT_1$ to $DT_n$ of the display device 20 at the time t2 shown in FIG. 7 (the display driving step DC1). As a result of the display driving step DC1, the pixel driving voltages $G_1$ to $G_n$ having the gradation voltages $V_1$ to $V_n$ corresponding to the first horizontal scanning line are applied to the display device 20.

In the example shown in FIG. 7, the output control unit 140 keeps the output setting information S1 at the logic level 0 over one horizontal scanning period and such a state is continuously kept over the next horizontal scanning period. Thus, the output control unit 140 applies the pixel driving voltages $G_1$ to $G_n$ having the gradation voltages $V_1$ to $V_n$ based on the pixel data signal group HD2 to the data lines $DT_1$ to $DT_n$ of the display device 20 (i.e., the display driving step DC2) at the first falling edge timing of the output timing signal STB after the time when the continuation of the state of the output setting information S1 is started, e.g., at a time t3 shown in FIG. 7. As a result of the display driving step DC2, the pixel driving voltages $G_1$ to $G_n$ having the gradation voltages $V_1$ to $V_n$ corresponding to the second horizontal scanning line are applied to the display device 20.

Thereafter, the output control unit 140 applies the pixel driving voltages $G_1$ to $G_n$ having the gradation voltages $V_1$ to $V_n$ based on the pixel data signal group HD3 to the data lines $DT_1$ to $DT_n$ of the display device 20 (the display driving step DC3) at the second falling edge timing of the output timing signal STB after the time when the continuation of the state of the output setting information S1 is started, e.g., at a time t4 shown in FIG. 7. As a result of the display driving step DC3, the pixel driving voltages $G_1$ to $G_n$ having the gradation voltages $V_1$ to $V_n$ corresponding to the third horizontal scanning line are applied to the display device 20.

In other words, by switching the contents of the output setting information S1 to the setting (logic level 0) to continue the operation in accordance with the basic output sequence immediately after the time t1 shown in FIG. 7, the output operation in accordance with the basic output sequence is continued, i.e., the display driving steps DC1 to DC3 are sequentially performed following the above-described correction step CC2.

As described above, the data driver 13 sequentially applies the offset voltages VOF1 and VOF2 for correcting the threshold voltage and mobility of the drive transistor to the display device 20 (CC1 and CC2) only once every three horizontal scanning periods (3H) according to the embodiment shown in FIG. 7. Within such three horizontal scanning periods, the data driver 13 applies the gradation voltages $V_1$ to $V_n$ for one horizontal scanning line based on the video signal to the display device 20 (DC1), subsequently applies the gradation voltages $V_1$ to $V_n$ for the next horizontal scanning line to the display device 20 (DC2), and further applies the gradation voltages $V_1$ to $V_n$ for the following horizontal scanning line to the display device 20 (DC3). In other words, after the processing for correcting the threshold voltage and mobility of the drive transistor (CC1 and CC2), driving for displaying images for one horizontal scanning line (DC1), driving for displaying images for the next horizontal scanning line (DC2), and driving for displaying images for the following horizontal scanning line (DC3) are sequentially executed.

As described above, the processing for correcting the threshold voltage and mobility of the drive transistor (Q2) formed in the display device 20 is performed only once every three horizontal scanning periods (3H). Thus, a period spent for the above-described correction processing (CC1 and CC2) and the above-described image display driving (DC1, DC2, and DC3) can be prolonged as compared to a case where such correction processing is executed every single horizontal scanning period or every two horizontal scanning periods as shown in FIG. 6.

Although the output timing signal STB is externally provided from the outside of the data driver 13 in the above-described embodiments, such an output timing signal STB may be generated in the data driver 13. In this case, as an internal circuit (not shown) for generating the output timing signal STB, an internal circuit capable of generating the output timing signal STB having a desired waveform and frequency set by an internal register is preferably employed.

Although the processing for correcting the drive transistor (CC1 and CC2) is performed only once every two or three horizontal scanning periods in the above-described embodiments, the processing for correcting the drive transistor may be performed only once every four or more horizontal scanning periods. If the number of horizontal scanning lines on which simultaneous correction is performed is increased, switching timing to select writing into and reading from the latches LTa and LTb in the latch circuits $LCC_1$ to $LCC_n$ shown in FIG. 4 becomes difficult. In view of this, three or more latches may be provided in each of the latch circuits $LCC_1$ to $LCC_n$, and a latch for holding a pixel data signal group may be switched thereamong for each horizontal scanning period.

Although the processing for correcting the threshold voltage of the drive transistor Q2 and the processing for correcting the mobility thereof are sequentially performed by applying the offset voltages (VOF1 and VOF2) to the drive transistors Q2 via the data lines in the above-described embodiments, only one of these may be performed. Alternatively, a correction voltage for correcting a characteristic other than the threshold voltage and the mobility may be applied to the data lines.

In sum, the data driver 13 includes the following data latch unit, gradation voltage converting unit, and output unit when driving, in accordance with a video signal, the display device (20) having the pixel cells (200), each including the light-emitting element (LD) and the drive transistor (Q2) for providing a driving current to the light-emitting element, at the respective intersections between the plurality of horizontal scanning lines ($DS_1$ to $DS_m$ and $WS_1$ to $WS_m$) and the plurality of data lines ($DT_1$ to $DT_n$).

More specifically, the data latch unit (132) holds the pixel data pieces ($A_1$ to $A_n$) representing the luminance levels of the pixels based on the video signal. The gradation voltage converting unit (134) generates the gradation voltages ($V_1$ to $V_n$) corresponding to the pixel data pieces held in the data latch unit. Only once every N (N is an integer of 2 or greater) horizontal scanning periods, the output unit (135) executes the processing (CC1 and CC2) for providing the correction voltages (VOF1 and VOF2) for correcting the characteristics of the drive transistors to the plurality of data lines and the processing (DC1, DC2, and DC3) for sequentially providing the gradation voltages for one horizontal scanning line, corresponding to each of the N horizontal scanning lines, to the plurality of data lines.

This application is based on a Japanese Patent Application No. 2015-231604 which is hereby incorporated by reference.

What is claimed is:

1. A display driver for driving, in accordance with a video signal, a display device having pixel cells, each including a light-emitting element and a drive transistor for providing a driving current to the light-emitting element, formed at respective intersections between a plurality of horizontal scanning lines and a plurality of data lines, the display driver comprising:

a gradation voltage converting unit configured to generate gradation voltages corresponding to pixel data pieces, the pixel data pieces representing luminance levels of pixels and being held by the video signal; and an output unit configured to execute, in N (N is an integer of 2 or greater) horizontal scanning periods, a first processing for providing a correction voltage for correcting a characteristic of the drive transistor to the plurality of data lines and a second processing for sequentially providing the gradation voltages for one horizontal scanning line, corresponding to each of N of the horizontal scanning lines, to the plurality of data lines.

2. The display driver according to claim 1, wherein the first processing is executed by the number of times fewer than N.

3. The display driver according to claim 1, wherein the first processing is executed by (N−1) times in the N horizontal scanning periods.

4. The display driver according to claim 1, wherein the first processing is executed by one every the N horizontal scanning periods.

5. The display driver according to claim 1, wherein the correction voltage is a voltage for correcting at least one of a threshold voltage and a mobility of the drive transistor.

6. The display driver according to claim 5, wherein the output unit provides a first offset voltage for correcting the threshold voltage to the plurality of data lines as the correction voltage, and provides a second offset voltage for correcting the mobility to the plurality of data lines as the correction voltage.

* * * * *